United States Patent [19]

Sukup

[11] Patent Number: 4,836,686

[45] Date of Patent: Jun. 6, 1989

[54] APPARATUS FOR STIRRING GRAIN IN RECTANGULAR BIN REGIONS

[76] Inventor: Eugene G. Sukup, Beeds Lake, Hampton, Iowa 50441

[21] Appl. No.: 205,382

[22] Filed: Jun. 10, 1988

[51] Int. Cl.[4] ..... B01F 7/08

[52] U.S. Cl. ..... 366/261; 366/282; 366/601

[58] Field of Search ..... 366/261, 281, 282, 283, 366/284, 601, 279, 348, 349, 318

[56] References Cited

U.S. PATENT DOCUMENTS 3,251,582 5/1966 Murphy ..... 366/261

3,410,537 11/1968 Fienhold ..... 366/261

3,584,842 6/1971 Sukup ..... 366/261

*Primary Examiner*—Robert W. Jenkins

*Attorney, Agent, or Firm*—Neuman, Williams, Anderson & Olson

[57] ABSTRACT

Grain stirring apparatus includes a traversing mechanism for supporting upper end portions of one or more stirrers and effecting back and forth movements thereof in two transversely related horizontal directions, the stirrer or stirrers being pivotal about a horizontal tilt axis parallel to one of such directions. Switches are connected in series and are arranged to deactivate the traversing mechanism when the tilt angle of a stirrer exceeds a certain threshold value.

10 Claims, 2 Drawing Sheets

APPARATUS FOR STIRRING GRAIN IN RECTANGULAR BIN REGIONS

BACKGROUND OF THE INVENTION

1. Field of the Invention

This invention relates to grain stirring apparatus and more particularly to grain stirring apparatus for stirring and aerating grain ot prevent spoilage thereof, the apparatus being effective to stir and aerate the grain in a region of generally rectangular shape. The apparatus of the invention automatically responds to variations in grain conditions and avoids undue stresses on component parts thereof. It is very efficient while being trouble-free and reliable in operation, and it is economically manufacturable.

2. Background of the Prior Art

An apparatus for stirring and aerating grain is disclosed in the Sukup U.S. Pat. No. 3,584,852 in which a stirrer is formed with a helical blade and is rotated about a vertical axis while being moved horizontally in a path such that substantially all grain in a bin may be periodically stirred and aerated. In apparatus for a circular bin as illustrated in said patent, a carriage is rotated about a central vertical axis of the bin while a carrier structure on the carriage is moved back and forth, radially inwardly and outwardly, the stirrer being suppported from the carrier structure.

A similar type of apparatus for a circular bin is shown in the Murphy U.S. Pat. No. 3,251,582 which discloses electrical circuitry for automatically controlling energization of a drive motor which effects rotation of a carriage or bridge about a central vertical axis of a bin, a stirrer or auger and an associated drive motor being supported through a universal joint from a structure which is movable radially inwardly and outwardly. The universal joint allows the stirrer or auger to tilt or trail back in response to resistance of the grain during movement through the grain and the drive motor for the auger is offset so that its gravity applies a torque about the tilt axis. A mercury switch is provided on the auger drive motor and is connected in series with the bridge drive motor, the mercury switch being opened when the auger tilts beyond a certain angle. The arrangement is limited to a circular bin in which the stirrer or auger is always moved in one direction about a central axis of the bin. It is also limited in that with rotation at a constant angular velocity about the central axis of the bin, the velocity movement of the auger and thereby the reaction forces applied thereto by the grain are proportional to the radial distance from the central axis which varies constantly during the radial inward and outward movements of the auger.

It is also known in the prior art to provide apparatus for stirring grain in a rectangular bin, using a traversing mechanism which supports and journals an upper end portion of a stirrer and which effects back and forth movements of the stirrer between opposite ends of a bin and also between opposite sides of the bin.

SUMMARY OF THE INVENTION

This invention was evolved with the general object of overcoming disadvantages of prior systems and of providing apparatus for efficiently stirring grain in bins of various configurations, sizes and dimensions while avoiding adverse effects of variations in grain conditions and otherwise providing uniform, reliable and trouble-free operation.

It is also an object of the invention to provide grain stirring apparatus which is relatively simple in construction and operation and which is economically manufacturable.

In accordance with the invention, a grain stirring apparatus is provided which is arranged for stirring grain in a region of generally rectangular shape with a traversing mechanism being provided for effecting back and forth movements of a stirrer in a first horizontal direction between opposite ends of a region while also effecting back and forth movements of the stirrer in a second horizontal direction between opposite sides of the region. As a result of the back and forth movements between the opposite ends of the region, forces are applied between the grain and the lower end of the stirrer which are effective to apply torques which tend to rotate the stirrer about a horizontal tilt axis which is parallel to the second horizontal direction of movement between the opposite sides of the region. Similarly, as a result of the back and forth movements in the second direction between the opposite sides of the region, torques are applied which tend to rotate the stirrer about a horizontal tilt axis parallel to the first horizontal direction of movement.

In accordance with the invention, two sensing means are provided for sensing the torques applies about one of such tilt axes and they are used to control energization of electric drive motor means for the traversing mechanism to stop the traversing mechanism when either of such torques exceeds a certain value. preferably, the torque sensing means are arranged to sense the torques applied as a result of the back and forth movements which have the highest velocity and when such velocities are substantially constant values, as is the case when operating to stir a rectangular region, the operation is uniform with respect to the resistance forces applied by the grain. The system does not have variable response characteristics, unlike the prior art arrangements for circular bins, and it is bi-directional in operation.

In accordance with a specific feature, the traversing mechanism is of a type which includes a carrier structure supported for pivotal movement about the tilt axis with the center of gravity of the carrier structure and associated parts, including the stirrer, being in approximate alignment with a lower portion of the stirrer, the stirrer being rotated about the tilt axis through an angle proportional to the force applied to the grain, in either direction. The sensing means preferably includes a pair of switches, such as mercury switches, which are mounted on the carrier structure to respond to tilting movement thereof. Thus, a simple arrangement is provided.

In accordance with another specific feature of the invention, the traversing mechanism includes a horizontal shaft which supports the carrier structure for reciprocable rectilinear movement therealong, the shaft being rotated and a roller being provided on the carrier structure for frictional engagement with the shaft with the roller being shifted about a shift axis between two positions for effecting movement of the carrier structure in opposite directions. With this type of traversing mechanism, the carrier structure and associated parts are rotatable about the axis of the shaft which forms the tilt axis.

Further features of the invention relate to the simultaneous stirring of a plurality of side-by-side regions of grain in a grain bin with a plurality of stirrers, using common portions of a traversing mechanism and with conjoint electrical control to obtain efficent and reliable operation. The arrangements of the invention are readily adaptable to achieve optimum results in stirring grain in bins having various lengths and widths, while minimzing the required equipment and costs.

This invention contemplates other objects, features and advantages which will become more fully apparent from the following detailed description taken in conjunction with the accompanying drawings.

DESCRIPTION OF PREFERRED EMBODIMENTS

Figure 1:
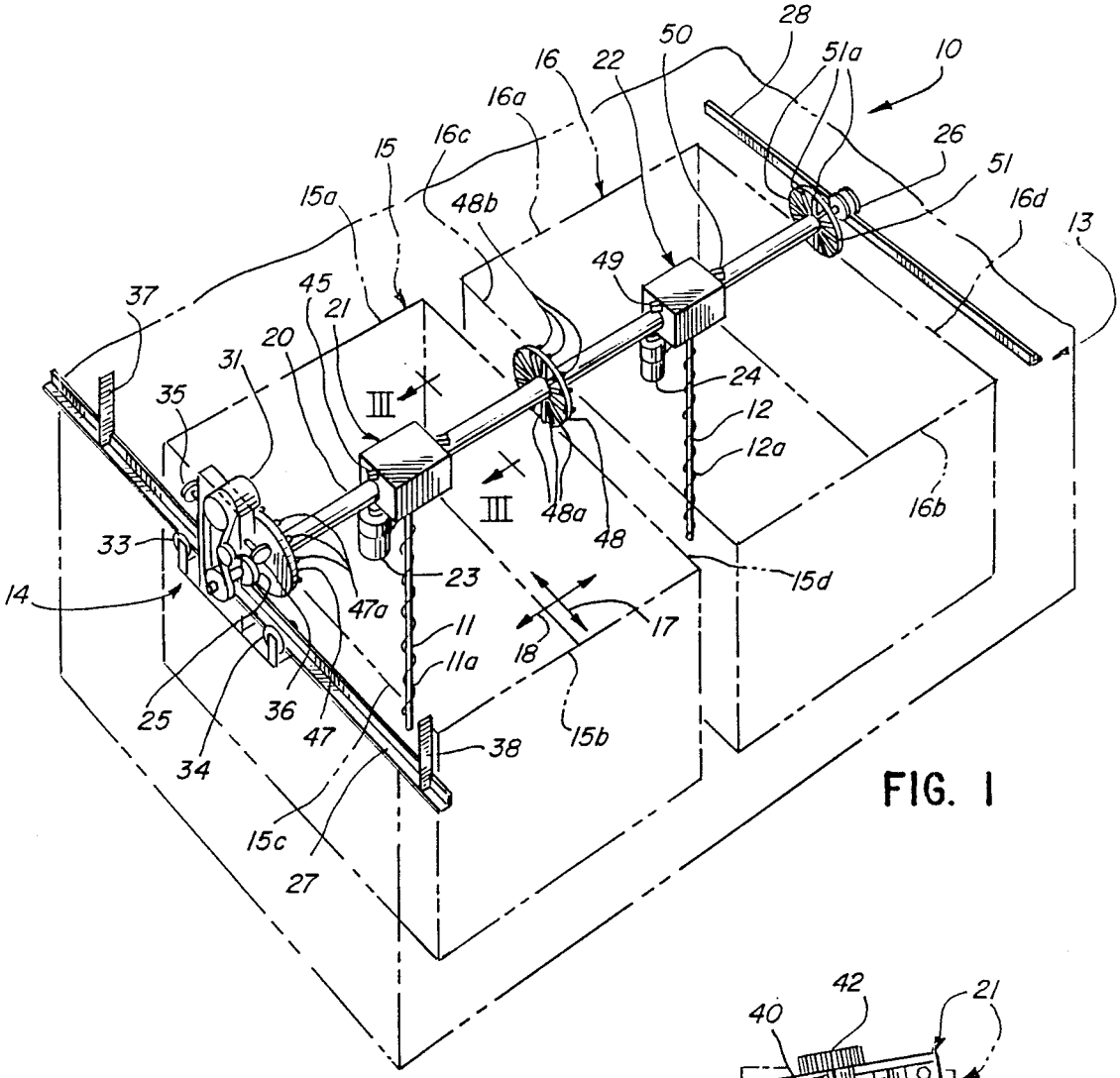
FIG. 1 is a perspective view of grain stirring apparatus constructed in accordance with the invention.

Reference numeral 10 generally designates grain stirring apparatus constructed in accordance with the principles of the invention. The apparatus 10, as diagrammatically illustrated in FIG. 1, includes two stirrers 11 and 12 which extend downwardly into a grain bin 13 and which are moved in horizonal directions through the grain by a traversing mechanism 14. The stirrers 11 and 12 have helical blades to move the grain upwardly as the stirrers are rotated in one direction, to mix and aerate the grain. In one preferred embodiment of the invention, only one stirrer is used, but as is shown, two or more stirrers may be used, the optimum number of stirrers being dependent upon a number of factors including the size of the bin 13 and its length and width dimensions.

In the illustrated arrangement, the traversing mechanism moves the stirrers 11 and 12 in two generally rectangular box-like regions 15 and 16 of the grain in bin 13, indicated in broken lines in FIG. 1. Stirrer 11 is moved back and forth along one horizontal axis, indicated by double-ended arrow 17, between opposite ends 15*a* and 15*b* of region 15. At the same time it is also moved back and forth along a transverse horizontal axis, indicated by double-ended arrow 18, between opposite sides 15*c* and 15*d* of region 15. Similarly, stirrer 12 is moved back and forth along axis 17 between opposite ends 16*a* and 16*b* of region 16 while also moving back and forth along axis 18 between opposite sides 16*a* and 16*b* of the region 16.

In the apparatus as diagrammatically ilustrated, the traversing mechanism 14 includes a horizontal shaft 20 which supports two carrier structures 21 and 22. The carrier structures 21 and 22 support and journal the stirrers 11 and 12 and also carry drive motors 23 and 24 for rotating the stirrers 11 and 12, the shafts of the stirrer drive motors 23 and 24 being coupled to the stirrers through a belt drive arrangement, for example. Wheels 25 and 26 are affixed to the opposite ends of the shaft 20 to engage support rails 27 and 28. A drive unit 30 is provided to one end which includes an electric drive motor 31 coupled to one end of the shaft 20, the drive unit 30 also including wheels or rollers 33 and 34 for engaging the underside of the rail 27. The drive unit 30 also includes a pair of switch actuators 35 and 36 which are engageable with stops 37 and 38.

In operation, the shaft 20 is rotated by the drive motor, through a suitable speed-reduction assembly within the unit 30 and the wheels 25 and 26 are thereby driven to move the shaft 20 in one direction along axis 17 until one of the switch actuators 35 or 36 engages an associated one of the stops 37 or 38, the direction of rotation of the carriage drive motor 31 being then reversed to effect movenent in the opposite direction along axis 17.

Figure 2:
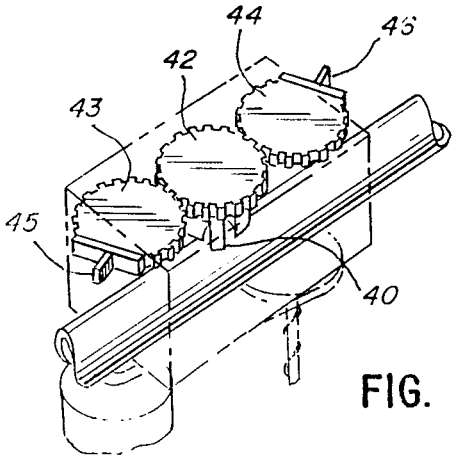
FIG. 2 is a perspective view of components of a traversing mechanism of the apparatus of FIG. 1.

At the same time, each of the carrier structures 21 and 22 is moved back and forth in the direction 18. Preferably, the mechanism used for this purpose is constructed in accordance with the disclosure of my prior filed application U.S. Ser. No. 166,326, filed March 9, 1988 the disclosure thereof being incorporated by reference. With reference to FIG. 2, the mechanism of carrier structure 21 may include a drive roller 40 which is frictionally engaged with the upper side of the shaft 20 and which is shifted about a fixed vertical shift axis between two positions to effect movement in one or the other of two directions on the axis 18. A member journalling the drive roller 40 is rotatable about the vertical shift axis and is directly coupled to a gear 42 which is meshed with two sector gears 43 and 44, arms 45 and 46 being secured to the sector gears 43 and 44. When the unit 21 reaches one limit of movement in a direction parallel to the axis 18, the arm 45 is engaged by one of a series of radially extending engagement members 47*a* on a circular plate 47 and the gear 42 is rotated about the shift axis to shift the axis of the drive roller from one position to the other and to reverse the direction of movement of the carrier structure 21 along the axis 18. At the opposite limit of movement, the arm 46 is engaged by one of a series of radially extending engagment members 48*a* on a circular plate 48, to again reverse the direction of movement.

The same type of mechanism is provided in the carrier structure 22, which includes arms 49 and 50, corresponding to the arms 45 and 46 of structure 21, for engagement by radially extending engagement members 48*b* on an opposite face of plate 48 and by radially extending engagement members 52*a* on a circular plate 52.

Figure 3:
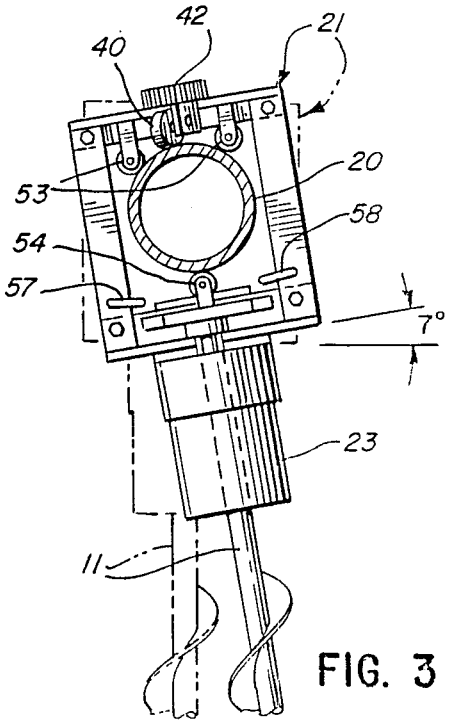
FIG. 3 is an end elevational view of a stirrer and associated components of the apparatus of FIG. 1.

The carrier structure 21 is restrained against pivotal movement about an axis parallel to the axis 17, by a pair of wheels 53 engageable with the top of shaft 20 and a wheel 54 engaged with the underside of shaft 20 at one end of the structure 21, as shown in FIG. 3, and by similar wheels engageable with the top of the shaft 20 and with the underside of the shaft 20 at the opposite end. The carrier structure 21 may however pivot about the axis of the shaft 20 in response to forces developed between the grain and the stirrer 11, from the component of movement along the axis 17. As is more clearly apparent from FIG. 3, the carrier structure and parts carried thereby, including the stirrer 11 and drive motor 23 are so located that the center of gravity is in a plane of symmetry through the axis of the stirrer 11 and through the axis of the shaft 20, and is aligned with a lower portion of the stirrer 11. As a result, the structure 21 is urged by gravity to the broken line position of FIG. 3 and is rotatable through an angle which is proportional to the torque resulting from forces developed between the grain and the stirrer 11 and acting in either direction parallel to the axis 17.

In accordance with the invention, a pair of mercury switches 57 and 58 are mounted on the carrier structure 21 and are positioned at equal and opposite angles with respect to the aforementioned plane of symmetry. Preferbly, both switches 57 and 58 are closed in the broken line position. Each is opened only when the angle exceeds a threshold value such as 7 degrees. Switches 57 and 58, and corresponding switches on the carrier structure 22 function to deenergize the carriage drive motor 31 when the forces applied between the grain and either of the stirrers is excessive, as a result of factors such as a high density, high moisture, etc. Rotation of the stirrers 11 and 12 is continued and, when the angle is reduced to a value below the threshold value, the carriage drive motor 31 is again energized to permit the horizontal movements to continue.

FIG. 3 is a schematic diagram of the electrical circuitry. The mercury switches 57 and 58 of the unit 21 and corresponding switches 59 and 60 of the unit 22 are connected in series with each other to normally complete a circuit between terminals 61 and 62 on the stirrer drive motor 23. Terminal 61 is also connected to a terminal 63 of a reversing switch 64 and to a terminal 65 of the carriage drive motor 31. Terminal 62 and another terminal 66 are connected to windings of the stirrer drive motor 23 which function to develop a certain AC supply voltage for operation of the carriage drive motor 31, and terminal 66 is connected to a terminal 67 of the reversing swithch 64 and to a terminal 68 of the carriage drive motor 31.

So long as all mercury switches 57–60 are closed, the supply voltage developed between terminals 62 and 66 of stirrer drive motor 23 is applied to a main winding of the carriage drive motor 31 which is connected between terminals 65 and 68. A phase winding of carriage drive motor 31 is connected to terminals 69 and 70 thereof, terminal 69 being connected to terminals 71 and 72 of switch 64 and terminal 70 being connected through a phase shift capacitor 74 to terminals 75 and 76 of switch 64.

As diagrammatically ilustrated, the reversing switch 64 has movable contacts 77 and 78 operated by the switch actuators 35 and 36. In the position as shown, terminal 63 is connected to the phase winding terminal 69 and terminal 67 is connected through the phase shift capacitor 74 to the other phase winding terminal 70 to produce rotation of the shaft of carriage drive motor 31 in one direction. In the opposite position of the contacts 77 and 78 of reversing switch 64, the connections are reversed to produce rotaion of the shaft of carriage drive motor 31 in the reverse direction.

The stirrer drive motor 23 as illustrated is a three phase motor having terminals 81, 82 and 83 for connection to a three phase power source through a disconnect switch 84, a single phase voltage being developed between taps of a winding thereof which is connected to the aforementioned terminals 62 and 66 for supply of a single phase operating voltage for the carriage drive motor 31. The stirrer drive motor 24 is also a three phase motor having terminals 85, 86 and 87 connected to terminals 81, 82 and 83 of motor 23 and to the disconnect switch 84. By way of example, 440–480 volt, three phase current may be supplied to the motors 23 and 24 and a 220–240 volt single phase supply voltage may be developed at terminals 61 and 62. Common ground connections to all of the components are provided, as indicated.

Figure 4:
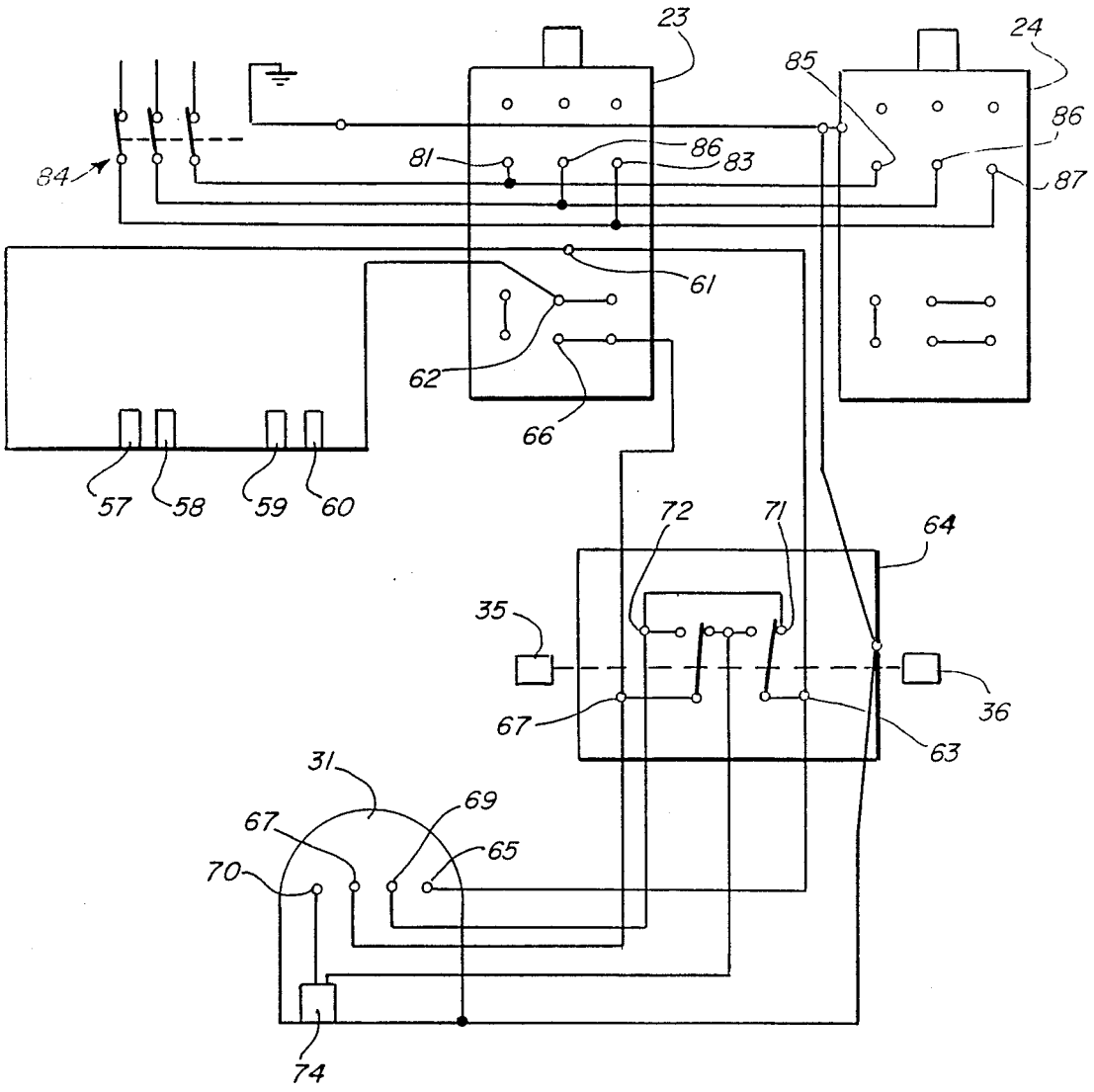
FIG. 4 is an electrical circuit diagram.

The circuitry is readily adapted for use in apparatus in which a single stirrer is provided or in which more than two stirrers are provided. In apparatus in which a single stirrer is used, the same circuit as shown in FIG. 4 may be used but without motor 24 and with mercury switches 59 and 60 replaced by a direct connection. In apparatus in which more than two stirrers are used, the drive motors or the additional stirrers are simply connected in parallel with the drive motors 23 and 24 and mercury switches of the carrier structures for the additional stirrers are connected in series with each other and with the illustrated mercury switches 57–60.

The invention thus provides an arrangement which is relatively simple and straight-forward in construction and operation and which is readily adaptable for grain bins of various configurations, while being automatically responsive to various in grain conditions and otherwise achieving efficient, reliable and trouble-free stirring of the grain.

It will be understood that modifications and variations may be effected without departing from the spirit and scope of the novel concepts of this invention.

I claim:

1. Apparatus for stirring grain stored in a grain bin, comprising: a stirrer for extending downwardly into grain in said bin and rotating about a generally vertical axis, a traversing mechanism for supporting and journaling an upper end portion of said stirrer and for effecting back and forth movements of said stirrer in a first horizontal direction between opposite ends of a region within said bin while effecting back and forth movements of said stirrer in a second horizontal direction between opposite sides of said region, first electric drive motor means for driving said stirrer to effect rotation thereof about said generally vertical axis, second electric drive motor means for driving said traversing mechanism to effect said back and forth movements of said stirrer, forces applied between the grain and the lower end of said stirrer as a result of said back and forth movements in said first horizontal direction being effective to apply torques tending to rotate said stirrer about a horizontal tilt axis parallel to said second horizontal direction and in the vicinity of said upper end portion of said stirrer, first sensing means responsive to a first torque applied about said tilt axis in one rotational direction during movement toward one end of said region, second sensing means responsive to a second torque applied about said tilt axis in an opposite rotational direction during movement toward the opposite end of said region, and energizing means for supplying operating voltages to said first and second electric drive motor means, said energizing means being coupled to and controlled by said first and second sensing means to deenergize said second electic drive motor means when either said first torque or said second torque exceeds a certain value while continuing to energize said first electric drive means.

2. Grain stirring apparatus as defined in claim 1, wherein said back and forth movements in said first horizontal direction are at a velocity greater than that of said back and forth movements in said second horizontal direction.

3. Grain stirring apparatus as defined in claim 1, wherein said traversing mechanism comprises a carrier structure movable back and forth in said second horizontal direction and including means supporting and journaling said upper end portion of said stirrer, said carrier structure and parts including said stirrer carried thereby having a center of gravity in alignment with a lower portion of said stirrer, said carrier structure being supported for pivotal movement about said tilt axis to be tilted about said tilt axis through an angle proportional to forces applied between the grain and said stirrer during movement toward either said one end or said opposite end of said region, each of said first and second sensing means comprising first and second electrical switch means operated at substantially equal and opposite angles of tilt of said carrier structure about said tilt axis.

4. Grain stirring apparatus as defined in claim 3, wherein each of said first and second sensing means comprises a mercury switch mounted on said carrier structure.

5. Grain stirring apparatus as defined in claim 3, wherein said traversing mechanism comprises a generally horizontal shaft having an axis aligned with said tilt axis with said carrier structure being supported on said shaft for pivotal movement about said axis thereof and for reciprocable rectilinear movement therealong between a pair of limit positions which define the opposite sides of said region.

6. Grain stirring apparatus as defined in claim 5, wherein said horizontal shaft is driven by said second electric drive motor means, and wherein said traversing mechanism further includes roller means on said carrier structure frictionally engaged with said shaft and shiftable between first and second conditions to effect said back and forth movements in said second horizontal direction.

7. Grain stirring apparatus as defined in claim 6, wherein said traversing mechanism further includes wheel means driven by said second electric drive motor means conjointly with the drive of said shaft, fixed track means engaged by said wheel means to effect said back and forth movements between said ends of said region, and switch means for reversing the direction of rotation of said second electic drive motor means at a pair of limit positions which define said ends of said region.

8. Grain stirring apparatus as defined in claim 1, wherein said first and second sensing means comprise a pair of electrical switches arranged to open when the torque in either of said directions exceeds a certain value, said pair of electrical switches being conected in series with each other and in series with said second electric drive motor means.

9. Grain stirring apparatus as defined in claim 1, further comprising a second stirrer for extending downwardly into grain in a second region of said bin separate from that traversed by the first-mentioned stirrer and for rotating about a generally vertical axis, said traversing mechanism further including means for supporting and journaling an upper end portion of said second stirrer and for effecting back and forth movements of said stirrer in said first horizontal direction between opposite ends of said second region while effecting back and forth movements of said stirrer in said second horizontal direction between opposite sides of said region, third electric drive motor means for driving said second stirrer to effect rotation thereof about said generally vertical axis thereof, forces applied between the grain and the lower end of said second stirrer as a result of said back and forth movements in said first horizontal direction being effective to apply torques tending to rotate said second stirrer about a second horizontal tilt axis parallel to said second horizontal direction and in the vicinity of said upper end portion of said second stirrer, third sensing means responsive to a third torque applied to said second stirrer about said second tilt axis in one rotational direction during movement toward one end of said region, fourth sensing means responsive to a fourth torque applied to said second stirrer about said second horizontal tilt axis in an opposite rotational direction during movement toward the opposite end of said region, said energizing means being arranged for supplying an operating voltage to said third electric drive motor means, and said energizing means being coupled to and controlled by said third and fourth sensing means to deenergize said second electic drive motor means when either said first torque or said second torque exceeds a certain value while continuing to energize said first and third electric drive means.

10. Grain stirring apparatus as defined in claim 9, wherein said first and second sensing means comprise a pair of electrical switches arranged to open when the torque about the first-mentioned tilt axis in either of said directions exceeds a certain value, and wherein said third and fourth sensing means also comprise a pair of electrical switches arranged to open when the torque about said second tilt axis in either of said directions exceeds a certain value, all of said electrical switches of both pairs being connected in series with each other and in series with said second electric drive motor means.

* * * * *